US006241117B1

(12) United States Patent
Wickins et al.

(10) Patent No.: US 6,241,117 B1
(45) Date of Patent: Jun. 5, 2001

(54) PRESSURE DIFFERENTIAL CONTAINMENT STRUCTURE

(76) Inventors: Steven R. Wickins, 9751 Newton St., Westminster, CO (US) 80030; John E. Schumacher, III, 6186 Sunshine Canyon Dr., Boulder, CO (US) 80302; Carl E. Lawrence, 6990 Lakeview Point, Longmont, CO (US) 80503

( * ) Notice: Subject to any disclaimer, the term of this patent is extended or adjusted under 35 U.S.C. 154(b) by 0 days.

(21) Appl. No.: 09/197,893

(22) Filed: Nov. 23, 1998

Related U.S. Application Data

(60) Provisional application No. 60/066,665, filed on Nov. 26, 1997.

(51) Int. Cl.[7] ..... B65D 7/46
(52) U.S. Cl. ..... 220/646; 220/650; 220/671
(58) Field of Search ..... 220/646, 671, 220/672, 678, 650

(56) References Cited

U.S. PATENT DOCUMENTS

| | | | | |
|---|---|---|---|---|
| 1,116,496 | * | 11/1914 | Schott | 220/671 |
| 1,516,694 | * | 11/1924 | Atkinson | 220/671 |
| 2,175,071 | * | 10/1939 | Walker | 220/671 |
| 3,647,100 | * | 3/1972 | Russell-French | 220/671 |
| 3,794,209 | * | 2/1974 | Mizuguchi et al. | 220/671 |
| 4,381,842 | * | 5/1983 | Dezawa | 220/671 |
| 4,589,565 | * | 5/1986 | Spivey | 220/671 |

* cited by examiner

*Primary Examiner*—Joseph M. Moy
(74) *Attorney, Agent, or Firm*—Louis G. Puls, Jr.

(57) ABSTRACT

A pressure differential containment structure, including a vacuum chamber and a pressure vessel, for operation in the pressure range of 1 to 2 atmospheres of pressure differential, using relatively thin wall material and incorporating strengthening members by folding or forming the walls of the containment structure itself. The structural configuration of the preferred embodiment is of rectilinear geometry with four lateral walls and two end walls. Each lateral wall component is preferably fabricated from at least one sheet, such as stainless steel, aluminum, or synthetic material including polymers and composites, to comprise reinforcing ribs or corrugations transverse to the longitudinal direction of the wall and include transverse flanges at each end. The lateral walls are preferably joined, such as by welding or adhesion, along longitudinal joints with four corner members, along with separate reinforcing corner plates and gusset plates, to form a lateral wall structure with two open ends, oriented either as front and back ends or as top and bottom ends. The end walls are preferably joined at transverse flange faces or can be sealed as with sealing rings under removable fastening means. An alternative embodiment is of cylindrical geometry with a laterally arcuate wall structure terminating in annular flange plates and two end walls. The lateral wall component is preferably first fabricated from at least one sheet to comprise reinforcing flutes or channels longitudinally along the full length of the lateral wall, such formed wall sheet component is subsequently arcuately rolled to be joined, as by welding or adhesion, along opposing longitudinal edges to configure the cylindrical wall structure. Annular flange plates are then welded along the fluted arcuate profile of each end of the cylindrical wall structure. As with the rectilinear configuration, the end walls are preferably welded at the transverse flange faces or can be sealed as with sealing rings under removable fastening means. Longitudinal corrugations in a rigid tube would support compressive or expansive loads as long as the length of the tube is appropriate to the material properties. The end flanges can be much thinner than those on a conventional cylindrical chamber due to support from the corrugations.

3 Claims, 5 Drawing Sheets

14
15
16
17
18
19

PRESSURE DIFFERENTIAL CONTAINMENT STRUCTURE

CROSS-REFERENCES TO RELATED APPLICATIONS

This is a Non-Provisional Application which hereby includes a reference to and claims the priority benefits of its corresponding Provisional Application Ser. No. 60/066,665 filed Nov. 26, 1997, which is pending. Such Provisional Application included a Verified Statement Claiming Small Entity Status under such filing date, and such status is still proper and desired. Also included were a Power of Attorney and Assignments executed by all applicants and recorded after the filing date.

BACKGROUND OF THE INVENTION

1. Field of the Invention

The invention relates generally to fluid pressure differential containment structures, and specifically to such containment structures configured to operate in the range of one to two atmospheres of pressure differential.

2. Description of the Related Art

Within the construction arts as an example of forming relatively thin yet strong containment walls is the corrugated siding or roofing used in relatively flat sheets for metal buildings. Another is the use of corrugations in rigid metal pipe, and further in flexible metal tubing (bellows).

Most pressure differential containment structures of the related art are constructed of metal plate (such as for rectilinear chambers) or relatively thick metal tube (such as for cylindrical chambers) and may or may not have additional and external reinforcing ribs. Thus inherent in such chamber or vessel structures are the large bulk and heavy weight of the structural materials, which leads to disadvantages and additional costs in fabrication, handling, shipping and application. Construction of, for example, a rectilinear chamber with suitably ribbed or corrugated wall reinforcement would result in a significant weight savings over such a chamber fabricated from plate with comparable structural integrity and stability. With suitable reinforcement, similarly significant savings are feasible in a cylindrical configuration.

SUMMARY OF THE INVENTION

The present invention provides a fluid pressure differential containment structure, such as a vacuum chamber or a pressure vessel in polyhedral configuration, for operation in the pressure range of 1 to 2 atmospheres of pressure differential, using relatively thin wall material, (i.e. thin relative to conventionally dimensioned material for comparable application) and incorporating strengthening members by folding or forming the walls of the containment structure itself.

The structural configuration of a preferred embodiment comprises a closed polyhedral configuration of rectilinear geometry with four lateral walls in a lateral wall structure and two end walls. Each lateral wall component is preferably fabricated from at least one sheet, such as stainless steel, aluminum, or synthetic material including polymers and composites, to comprise integral reinforcing rib or corrugation contours transverse to the longitudinal direction of the wall, whereby 'longitudinal' indicates along the direction between open ends of the lateral wall structure, whether oriented horizontally or vertically. Each lateral wall includes transverse flanges at each joining edge. The lateral walls are preferably joined, such as by welding or adhesion, along longitudinal joints with four corner members. The end walls are preferably joined at transverse flange faces or can be sealed as with sealing rings under removable fastening means.

An alternative embodiment is of cylindrical geometry with a laterally arcuate wall terminating in transverse annular flange plates and two end walls. The lateral wall component is preferably first fabricated from at least one sheet to comprise reinforcing flutes or channels longitudinally along the full length of the lateral wall. Such formed sheet component is subsequently arcuately rolled to be joined, as by welding or adhesion, along opposing longitudinal edges to configure the cylindrical wall structure. Annular flange plates are then welded along the fluted arcuate profile of each end of the cylindrical wall structure. The edge-on profile functions to reinforce the strength of the annular flange plate, which allows correspondingly thinner material. As with the rectilinear configuration, the end walls are preferably welded at the transverse flange faces or can be sealed as with sealing rings under removable fastening means.

Since flexible cylindrical bellows do not intrinsically support longitudinal compressive or expansive forces, such a cylindrical configuration, with circumferential corrugations, would not be a feasible application of the present invention. However, longitudinal strengthening members in a rigid tube would support compressive or expansive loads as long as the length of the tube is appropriate to the material properties. The end flanges can be much thinner than those on a conventional cylindrical chamber due to support from the flute or channel edge profiles.

It is an object of the present invention to provide pressure differential containment using significantly thinner wall material than conventional such chambers and vessels.

It is another object of the present invention to provide the incorporation of strengthening members by folding or forming the wall components of the containment structure material itself and joining the walls by means of further reinforcing corner members.

It is a further object of the present invention to provide operation of such containment in the pressure range of 1 or 2 atmospheres of pressure differential.

It is a still further object of the present invention to provide such containment with fabrication in both polyhedral and cylindrical configurations.

Other objects and advantages of the present invention will become evident when the following detailed description is read in conjunction with the accompanying drawings of preferred embodiments of the invention.

REFERENCE NUMERALS IN DRAWING

10 rectilinear sheet

11 inner fold

12 outer fold

13 flange fold

14 end flange

15 corner member

16 fold of corner member

17 contact surface of corner member

18 corner plate

19 gusset plate

DESCRIPTION OF THE PREFERRED EMBODIMENTS

Whereas most chambers and vessels for pressure differential containment are constructed of plate (such as for rectilinear chambers) or tube (for cylindrical chambers) and may or may not have reinforcing ribs added, the present invention uses significantly thinner wall material and incorporates strengthening members by folding or forming the wall components of the vessel itself. Construction of a rectilinear chamber with walls configured according to the present invention results in a weight savings of 70 to 80 percent over such a chamber fabricated from plate, and a significant saving in fabrication expense over a structure with separate reinforcing attached.

Figure 1:
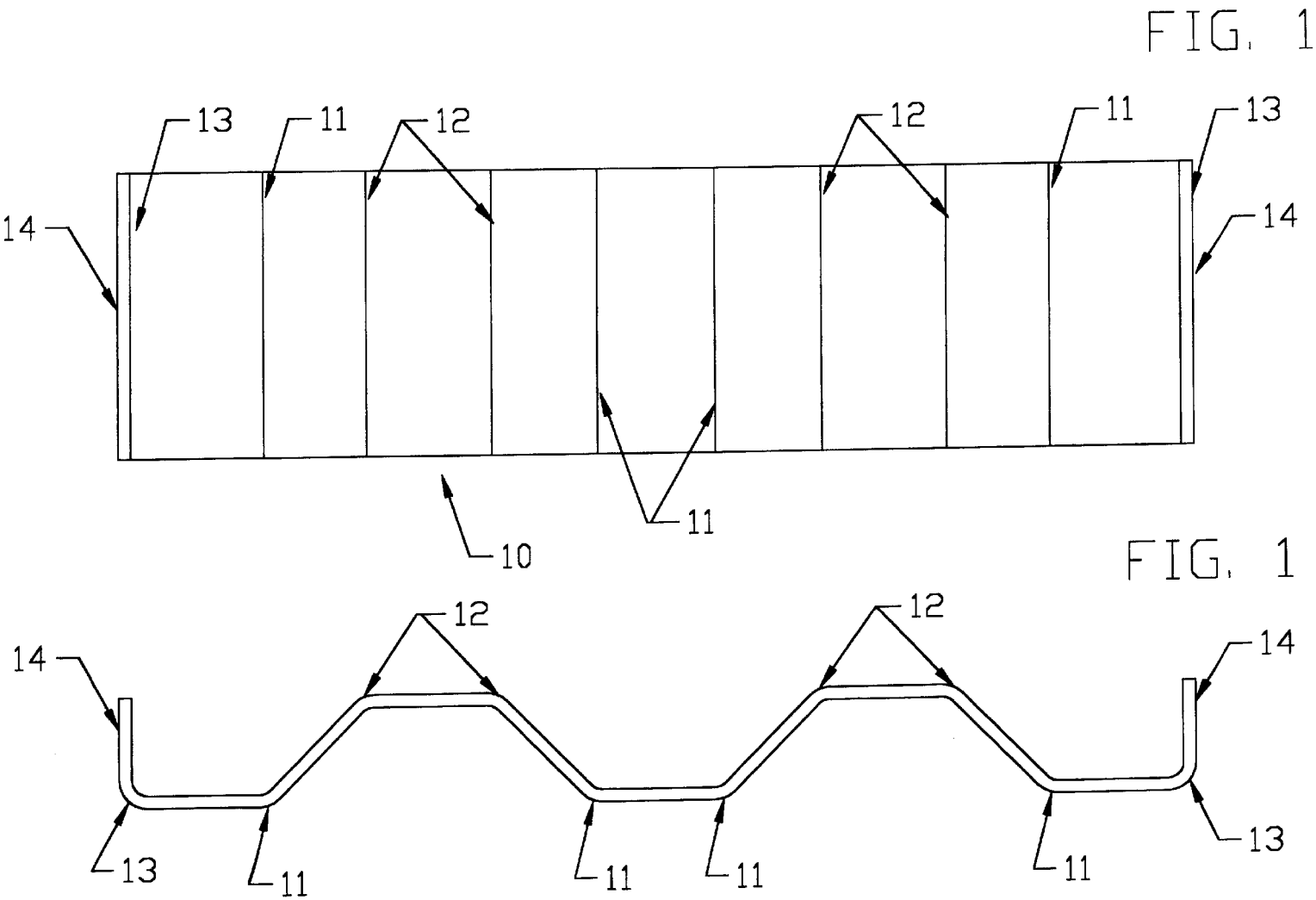
FIGS. 1A and 1B show side and edge-on views of one wall component for a rectilinear chamber.

FIG. 1A shows a side view of one wall component for a rectilinear chamber according to a preferred embodiment of the present invention. A rectilinear metal sheet 10 is multiply folded transversely to its longitudinal direction. Folds 11 are disposed inwardly with respect to the contained volume and folds 12 are counter disposed outwardly, forming strengthening members such as ribs or corrugations parallel to the end edges of said rectilinear metal sheet 10.

Formed by transverse folds 13, end flanges 14 for joining and sealing purposes are also disposed in the same sheet 10. This gives a very straight flat surface near the end fold 13 where, for example, an O-ring seal may be applied. The folds 11, 12, 13 are spaced to allow significant flat areas for mounting surfaces or feedthrough openings. This particular pattern is easy to fabricate from relatively thick sheet material. A stainless steel sheet of 10 gauge (0.134 in, 3.40 mm) can be used to span up to approximately 3 feet (0.9 m) and could be of virtually any practical length. A larger span could be supported with stainless steel of 7 gauge (0.184 in, 4.67 mm). Thicker stainless steel sheet could be formed with appropriate equipment.

The edge-on profile shape shown in FIG. 1B is easily fabricated on a conventional press brake. With special tooling the preferred embodiment could be modified to have all angles 90 degrees and consequently produce a more rigid structure with less material. With thicker material such as 7 gauge stainless the flat surfaces could be approximately 6 inches (15 cm) or more across without excessive wall deflection under load. Holes or openings in the chamber wall components for ports or feedthroughs could be punched or cut in the material before folding to simplify fabrication.

Figure 2:
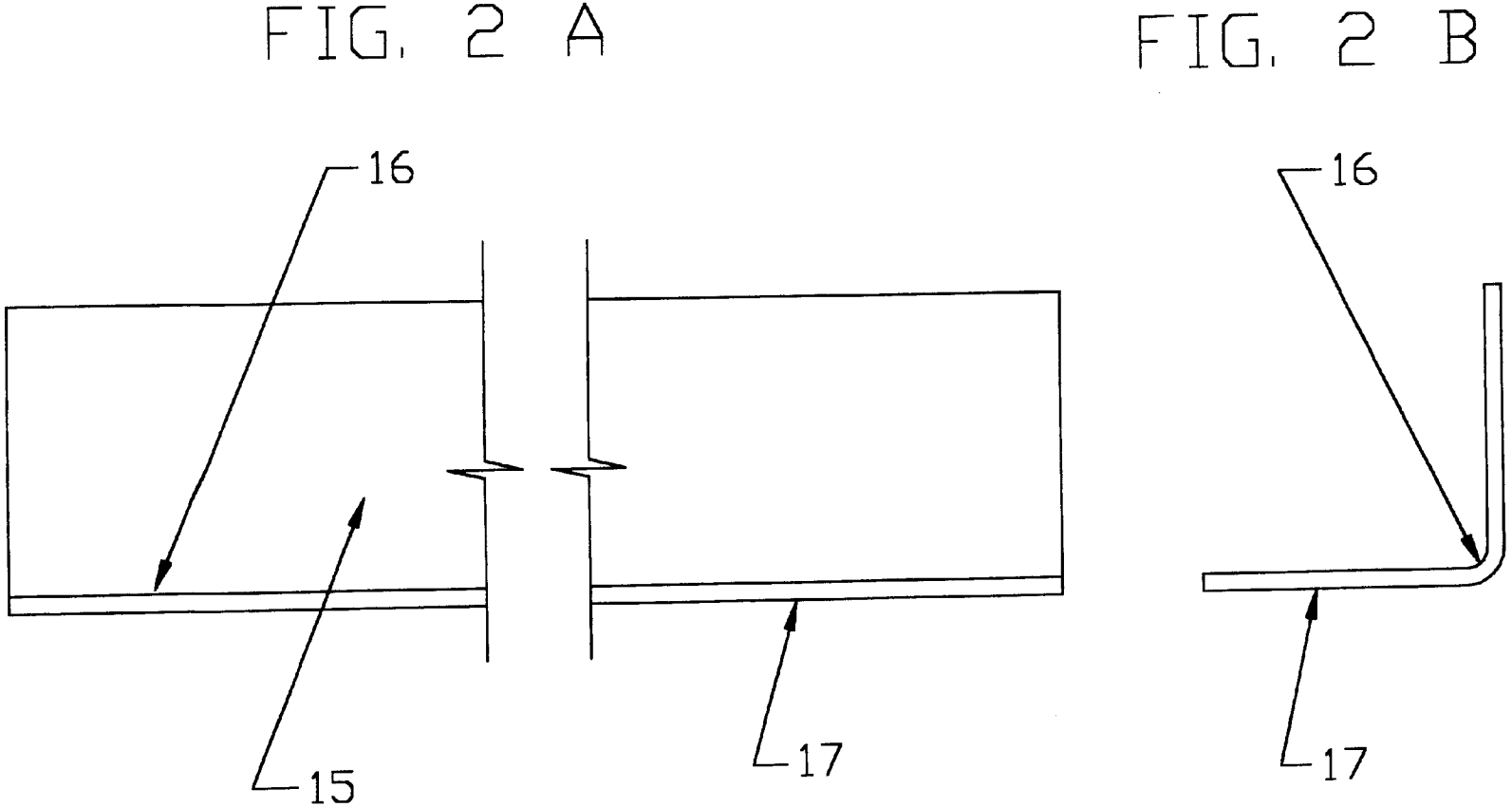
FIGS. 2A and 2B show side and end views of an angular corner member of a rectilinear chamber.

The compressive or expansive stresses from the end of the containment structure are primarily supported by corner members 15 which, as shown in FIGS. 2A and 2B, are angular. Formed for example from flat stock by a fold 16 to a right angle between contact surfaces 17 results in an open angle cross-sectional profile, FIG. 2B. Such corner members 15 could also be triangular in profile, with a welded or adhered closure plate opposite the right angle or formed with such profile as by extrusion or molding. A further alternate configuration for said corner members 15 is a box-shaped profile, formed as by extrusion or molding. Said box-shaped profile could be square or rectangular. The joining of side wall sheets 10 along the full contour of each side edge is encompassed within the width of each corresponding contact surface 17 of corner member 15 between adjacent side walls, as by welding, enabling the -formation of a lateral wall structure with two open ends, longitudinally oriented either vertically or horizontally.

The length of the chamber is of little consequence from a structural point of view. It is limited mainly by the sizes of available sheet material. The important parameter is the cross-sectional area of the ends. For a larger chamber, the four structural members joined in the corners may be inadequate to carry loads from the ends. In this case, additional longitudinal members may be added along the sides of the chamber from one end to the other to distribute the load. Such members would be joined to a surface of the chamber to prevent buckling or warping under a compressive load.

Figures 3, 3A, 3B:
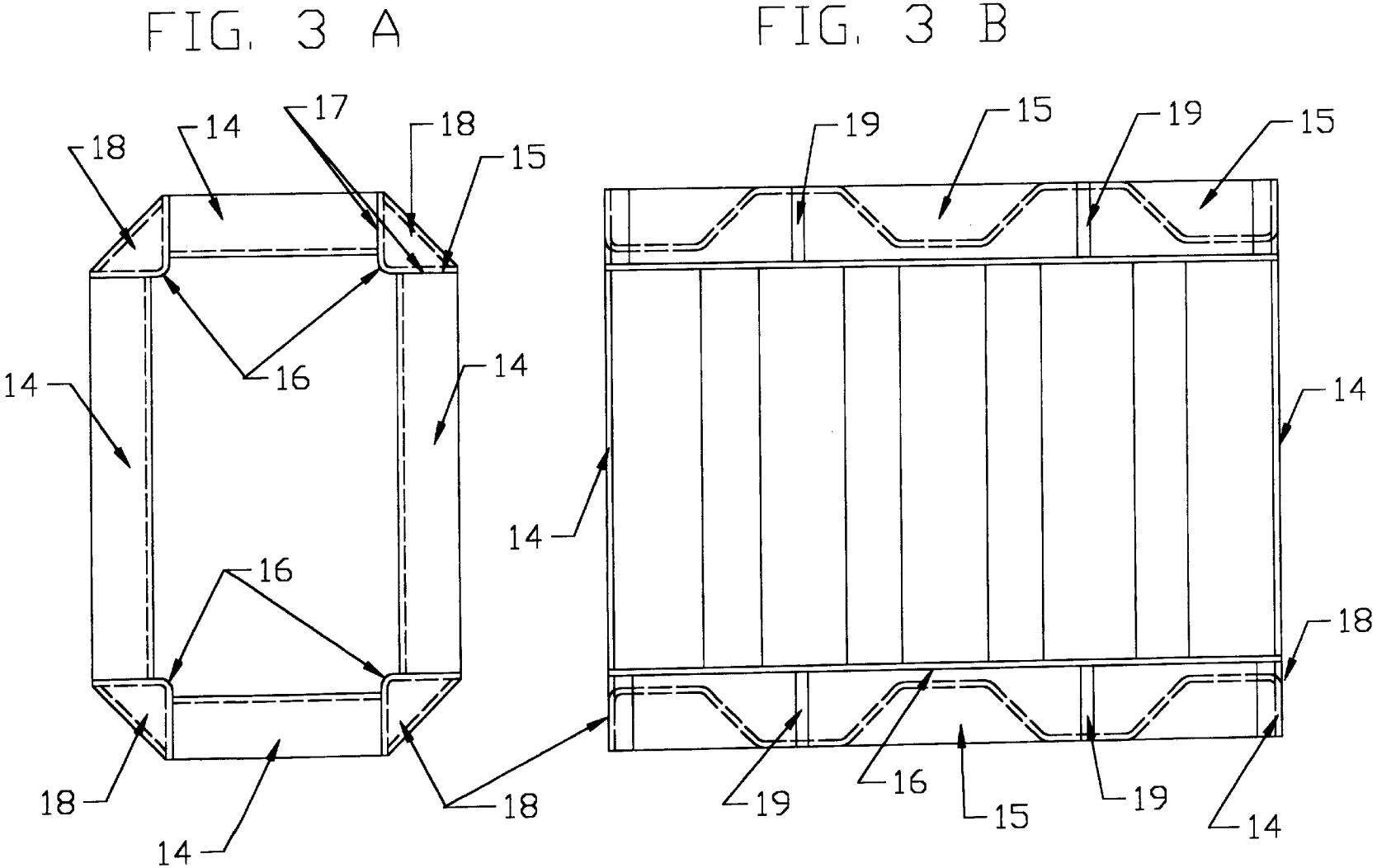
FIGS. 3A and 3B show end and side views of a complete assembly of a rectilinear chamber without end walls.
Figure 4:
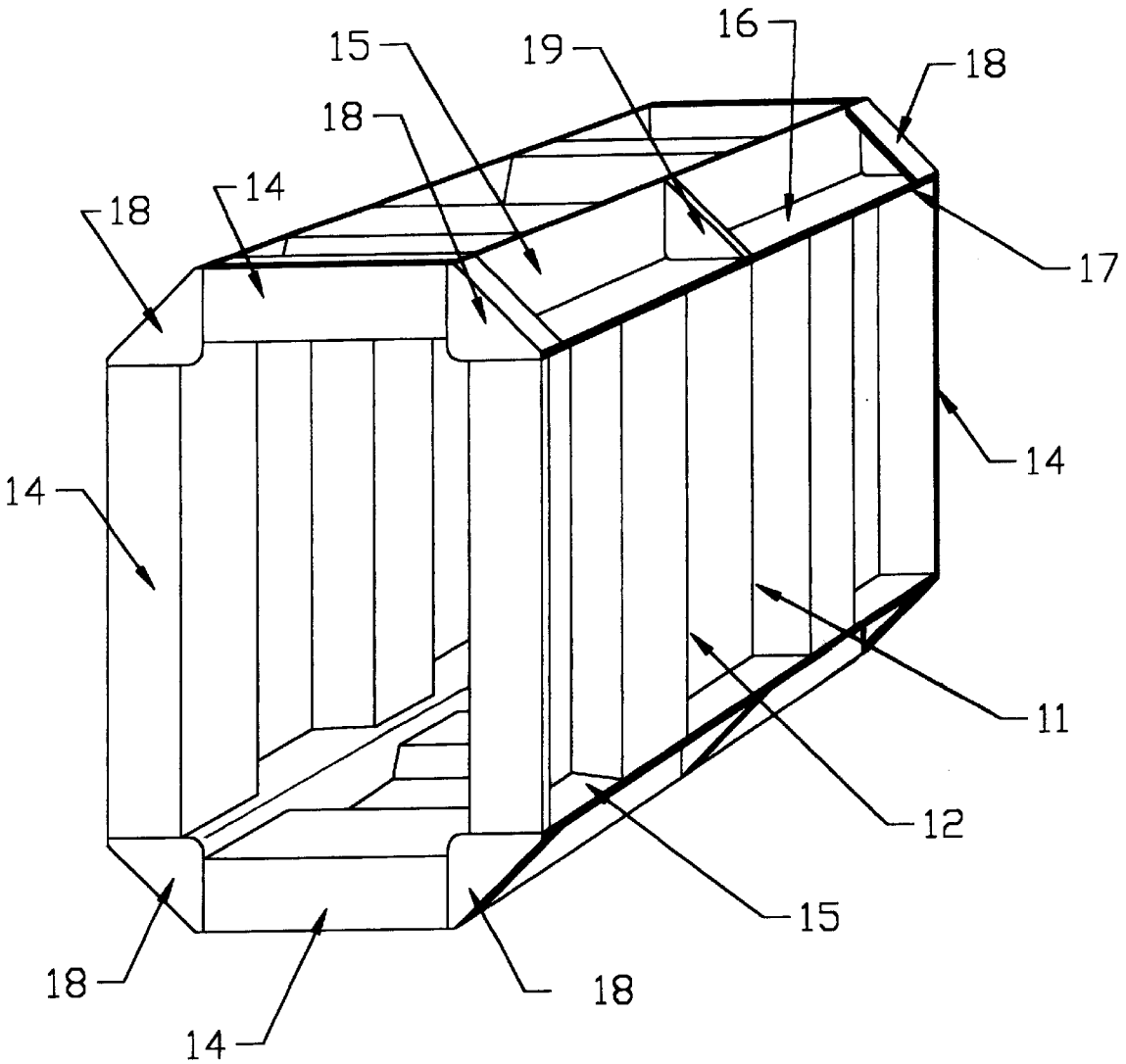
FIG. 4 shows a perspective view of a rectilinear chamber with end walls.
Figure 5:
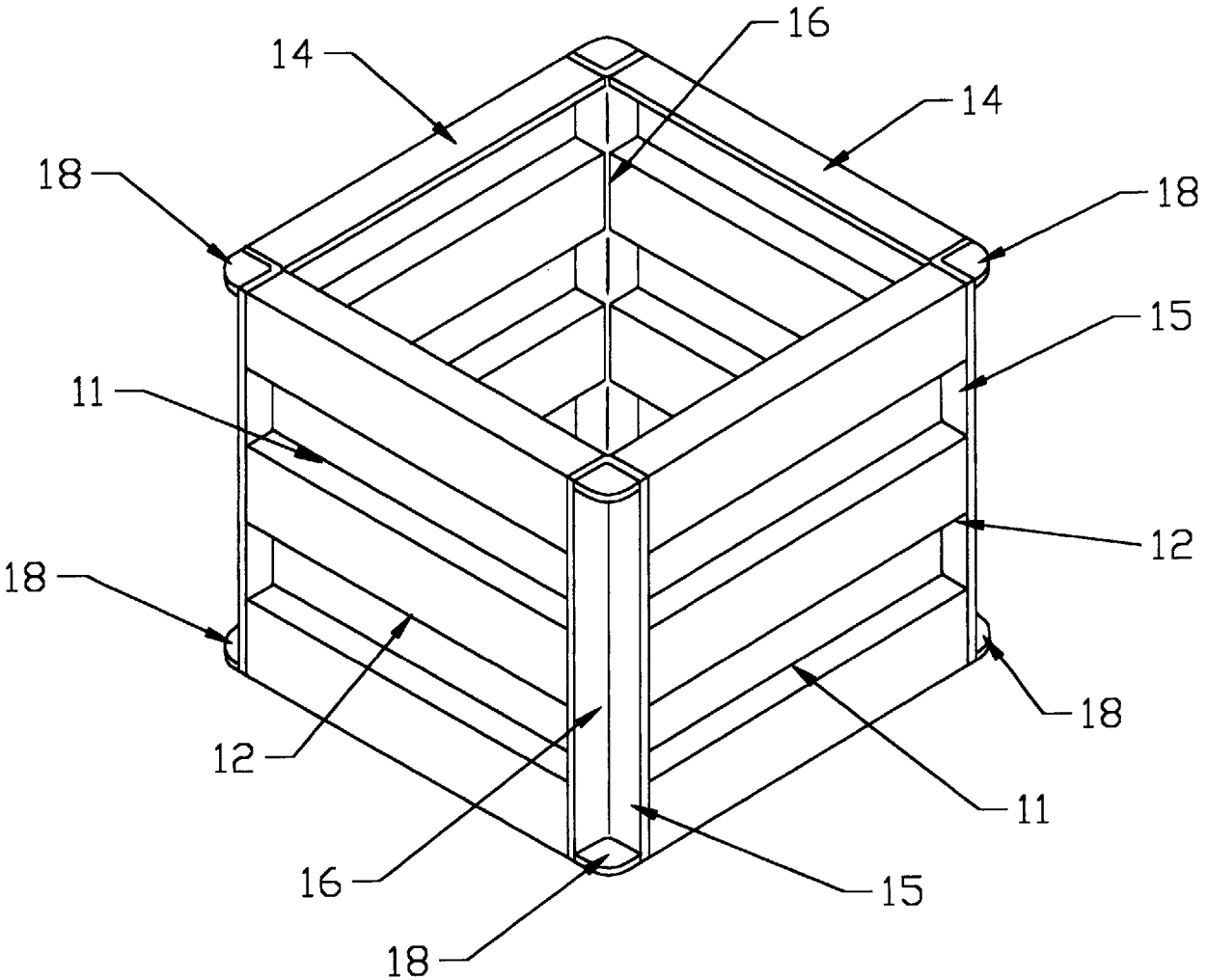
FIG. 5 shows a perspective view of a vertically oriented tank configuration.

Corner plates 18 are a vital part of the construction of a rectilinear chamber of the present invention, as shown in FIGS. 3A and 3B. At a minimum four are required for a system with a door at one end, and eight are required for a system with a door on both ends. Gusset plates 19 are also of major importance for reinforcement between and mutually perpendicular to the internal faces of a corner member 15 disposed centrally or distributively within interstitial regions relatively remote from the joining profiles on the contact surfaces 17 of the corner member 15, as shown in FIGS. 3A and 3B.

FIG. 3 shows a complete rectilinear assembly of lateral wall structures, corner members, and corner plates, depicted for clarity without end walls, plates or doors. For A) a horizontal chamber with a single door the back end wall can be fabricated from a thick solid plate of stainless steel, or like other thin-wall-sheet chambers, from sheet metal with separate external reinforcing ribs. Analogously to the side wall components according to the invention, the back end wall can also be fabricated from relatively thin sheets with transverse ribs or corrugations. Similarly the door can be fabricated from almost any heavy plate material or of contoured sheet configuration according to the present invention which will support the load (synthetic materials, such as Lucite, Lexan, etc., composite materials, aluminum, and stainless steel are examples). A vertical vessel with open top would simply have a bottom end comprising a flat plate.

The above descriptions should not be construed as limiting the scope of the present invention, but rather as merely providing illustrations of some of the presently preferred embodiments of this invention. Various other embodiments and ramifications are possible within the scope of the invention. Thus the scope of the invention should be determined by later filed claims and their legal equivalents based on this specification and drawings, rather than by the examples given.

What is claimed is:

1. A fluid pressure differential containmeent structure, including such structures forming vacuum chambers and pressure vessels, characterized in that the comtainment functions in the range of one to two atmospheres of pressure differential, using relatively thin wall material, said fluid pressure differential containment structure comprising a polyhedral configuration with: multiple walls of the containment structure including at least one lateral wall component and two end wall components, said multiple walls each including strengthening members integrally fabricated from the wall material of the containment structure itself, the wall material strengthening members so fabricated, as by folding and forming, into a reinforcing wall configuration for each lateral and end wall component, and said at least one lateral wall component and two end wall components joined so as to form a fluid-tight seal, including by welding and adhesion, to construct from said reinforcing wall configurations and mutually corresponding reinforcing corner members, including separate reinforcing corner plates and gusset plates, a sealing configuration free of internal supports, with ports and feedthroughs including sealing rings under removable fastening means.

2. A fluid pressure differential containment structure as set forth in claim 1 wherein the containment structure comprises a rectilinear enclosure with four lateral walls, each included lateral wall component fabricated from at least one sheet into reinforcing contours, including ribs and corrugations, transverse to the longitudinal direction of the wall component and including transverse flanges at each wall end, and joined one to another so as to form fluid-tight seals, including by welding and adhesion, along longitudinal joints with four corner members, including further and separate reinforcing corner plates and gusset plates, to form a lateral wall structure with two open ends oriented as front and back ends, and two end walls, each included end wall component fabricated, in analogous configuration to the lateral wall component, into reinforcing contours, including ribs and corrugations, which are transverse to the direction of the longest dimension of the end wall, and joined so as to form a fluid-tight seal, including by welding and adhesion, to the respective open end of the lateral wall structure at orthogonal flange faces in the sealing configuration.

3. A fluid pressure differential containment structure as set forth in claim 1 wherein the containment structure comprises a vertically oriented pressure vessel in a rectilinear open tank configuration with four lateral walls, each included lateral wall component fabricated from at least one sheet into reinforcing contours, including ribs and corrugations, transverse to the longitudinal direction of the wall component and including transverse flanges at each wall end, and joined so as to form a fluid-tight seal, including by welding and adhesion, along longitudinal joints with four corner members, including further and separate reinforcing corner plates and gusset plates, to form a lateral wall structure with two open ends oriented as top and bottom ends, and one bottom end wall, such included end wall component fabricated from a flat plate and joined so as to form a fluid-tight seal, including by welding and adhesion, to the respective open bottom end of the lateral wall structure at orthogonal flange faces in the sealing configuration.

* * * * *